US010981256B2

(12) United States Patent
Aoki et al.

(10) Patent No.: US 10,981,256 B2
(45) Date of Patent: Apr. 20, 2021

(54) MULTI-STAGE BATCH POLISHING METHOD FOR END SURFACE OF OPTICAL FIBER CONNECTOR, AND POLISHING FILM

(71) Applicants: NTT Advanced Technology Corporation, Kawasaki (JP); Mipox Corporation, Shinjuku-ku (JP)

(72) Inventors: Kenji Aoki, Kawasaki (JP); Naoki Sugita, Kawasaki (JP); Toshihiro Igawa, Shinjuku-ku (JP); Mitsunobu Shishido, Shinjuku-ku (JP)

(73) Assignees: NTT Advanced Technology Corporation, Kawasaki (JP); Mipox Corporation, Shinjuku-ku (JP)

( * ) Notice: Subject to any disclaimer, the term of this patent is extended or adjusted under 35 U.S.C. 154(b) by 345 days.

(21) Appl. No.: 15/970,041

(22) Filed: May 3, 2018

(65) Prior Publication Data

US 2018/0345440 A1 Dec. 6, 2018

Related U.S. Application Data

(63) Continuation of application No. PCT/JP2015/082785, filed on Nov. 20, 2015.

(51) Int. Cl.
*B24B 19/22* (2006.01)
*B24B 19/00* (2006.01)
(Continued)

(52) U.S. Cl.
CPC ..... *B24B 19/226* (2013.01); *B24B 19/00* (2013.01); *B24B 21/00* (2013.01); *B24B 21/002* (2013.01);
(Continued)

(58) Field of Classification Search
CPC ..... B24B 19/226; B24B 19/00; B24B 21/00; B24B 21/002; B24B 47/12; B24B 51/00; B24D 11/04; B24D 13/145
See application file for complete search history.

(56) References Cited

U.S. PATENT DOCUMENTS 449,930 A * 4/1891 Dubey ..... B24D 11/00 451/529
875,936 A * 1/1908 Landis ..... B24D 11/00 451/527
(Continued)

FOREIGN PATENT DOCUMENTS

FR 2928291 A3 * 9/2009 ..... B24D 11/04
JP 58183899 10/1983
(Continued)

*Primary Examiner* — Joseph J Hail
*Assistant Examiner* — J Stephen Taylor
(74) *Attorney, Agent, or Firm* — Lipsitz & McAllister, LLC

(57) ABSTRACT

A polishing method and a polishing film are provided for automatically performing multi-stage batch polishing on an end surface of a workpiece. An end surface of a workpiece and a polishing plate are moved relative to each other while bringing the end surface of the workpiece into contact with a polishing film of the polishing plate. The end surface is moved in a circular motion with a diameter 2 R relative to the polishing film; the center of the circular motion is moved linearly by a distance S on the polishing film; the polishing film is provided with first, second, and third polishing surfaces; and the polishing film is further provided with cleaning surfaces between the polishing surfaces so that the range of the distance S in which one rotation in the circular motion crosses over different polishing surfaces is reduced, or does not cross over different polishing surfaces.

17 Claims, 15 Drawing Sheets

(51) Int. Cl.

| | |
|---|---|
| ***B24B 21/00*** | (2006.01) |
| ***B24B 51/00*** | (2006.01) |
| ***B24D 11/04*** | (2006.01) |
| ***B24B 47/12*** | (2006.01) |
| ***B24D 13/14*** | (2006.01) |

(52) U.S. Cl.
CPC ..... *B24B 47/12* (2013.01); *B24B 51/00* (2013.01); *B24D 11/04* (2013.01); *B24D 13/145* (2013.01)

(56) References Cited

U.S. PATENT DOCUMENTS 5,727,989 A * 3/1998 Ohno ..... B24B 11/00 451/163
6,277,160 B1 * 8/2001 Stubbs ..... B24D 11/04 51/293
7,410,413 B2 * 8/2008 Woo ..... B24D 11/001 451/527
9,211,627 B2 12/2015 Andou et al.
2008/0070481 A1 * 3/2008 Tamura ..... B08B 1/00 451/28
2013/0331008 A1 * 12/2013 Andou ..... B24B 19/226 451/164

FOREIGN PATENT DOCUMENTS

| | | |
|---|---|---|
| JP | 5157940 | 6/1993 |
| JP | 8118241 | 5/1996 |
| JP | 929599 | 2/1997 |
| JP | 10235542 | 9/1998 |
| JP | 3773851 | 5/2006 |
| JP | 2007290372 | 11/2007 |
| JP | 5714932 | 5/2015 |

* cited by examiner (Rear)

(Front)

MULTI-STAGE BATCH POLISHING METHOD FOR END SURFACE OF OPTICAL FIBER CONNECTOR, AND POLISHING FILM

This application is a continuation of international application number PCT/JP2015/082785 filed on Nov. 20, 2015, which is incorporated herein by reference in its entirety and for all purposes.

TECHNICAL FIELD

The present invention relates to a polishing method and a polishing film for a workpiece, in particular, for collectively performing multi-stage polishing including rough polishing, intermediate polishing, and finish polishing on an end surface of an optical fiber connector.

BACKGROUND ART

Optical fiber connectors composed of optical fibers and ferrules are widely used in communication networks that use optical fibers. In order to impart the desirable optical characteristics to the optical fiber connector, an end surface thereof is accurately polished through multiple polishing stages.

The multiple polishing stages for the end surface of the single core optical fiber connector may include rough polishing, intermediate polishing, and finish polishing, and each polishing stage may be performed using multiple polishing films each of which has abrasive grains of a different type and size. Generally, more polishing processes are performed for polishing the end surface of a multi core optical fiber connector as compared with that of a single core optical fiber connector.

A huge number of optical fiber connectors are polished in the field with each optical fiber connector being polished by multiple polishing processes each of which uses multiple different polishing films. The work therefore requires a long time and is complicated. Mistakes are apt to occur when different polishing films are installed and removed from the polishing apparatus for each of the polishing processes including rough polishing, intermediate polishing, and finish polishing. Furthermore, a large number of polishing and cleaning apparatuses are required to polish a huge number of optical fiber connectors, resulting in increased costs and installation space.

Heretofore, an automatic polishing machine has been proposed for accurately polishing the end surface of optical fiber connectors, wherein each of the polishing devices successively performs rough polishing, intermediate polishing and mirror finishing while each of the cleaning devices performs cleaning, thereby preventing abrasive grains of different types from mixing (JP-A-H05-157940: patent document 1).

For the purpose of eliminating the working time required to replace the abrasives for each of the polishing processes performed on the optical fiber connector, a method was proposed in which an optical fiber connector and a polishing board are moved relative to each other, the polishing board having a polishing surface, predetermined portions of which are each coated with an abrasive of a different type and particle size (JP-U-S57-065312: patent document 2).

A polishing film used for optical connector ferrules was proposed, the film being obtained by providing a base film with multiple polishing surfaces each of which has a different size of abrasive grain, wherein there is no gap between the multiple polishing surfaces, or there is a groove between the multiple polishing surfaces so as to discharge waste material from the polishing surfaces (JP-A-2007-75975: patent document 3).

CITATION LIST

Patent Document

Patent Document 1: JP-A-1105-157940
Patent Document 2: JP-U-S57-065312
Patent Document 3: JP-A-2007-75975
Patent Document 4: JP-B-3773851
Patent Document 5: JP-B-5714932

SUMMARY OF INVENTION

Problems to be Solved by the Invention

The conventional polishing machine for automatically performing rough polishing, intermediate polishing and mirror finishing was not intended to reduce the number of polishing apparatuses or cleaning apparatuses, and therefore fails to save space. The conventional method for polishing the end surface of optical fiber connectors by using polishing films with multiple polishing surfaces could not improve polishing accuracy because the end surface of the connector was not cleaned.

In view of the above problems, the object of the present invention is to provide a polishing method for automatically and collectively performing multiple polishing processes without requiring separate polishing apparatuses or polishing films for each of the polishing processes in multi-stage polishing of the end surface of optical fiber connectors. Another object of the present invention is to provide a polishing method for easily and highly accurately performing multi-stage polishing on the end surface of optical fiber connectors in a continuous operation of the polishing apparatus without requiring the replacement of polishing films.

It is a further object of the present invention to provide a polishing film suitable for the multi-stage batch polishing method.

Solution to the Problem

Provided herein in one embodiment of the present invention is a polishing method for collectively performing multi-stage polishing on a workpiece by moving the end surface of the workpiece and a polishing plate relative to each other within a plane parallel to the reference plane while bringing the end surface of the workpiece into contact with a polishing film disposed on the polishing plate, wherein the end surface of the workpiece is moved in a circular motion with a diameter 2 R relative to the polishing film and the center of the circular motion is moved linearly in one direction by a predetermined distance S on the polishing film, wherein the polishing film comprises first, second and third polishing surfaces along the direction of linear movement, the length of each polishing surface in the direction of linear movement is equal to or greater than the diameter 2 R of the circular motion, and wherein the polishing film further comprises a first cleaning surface between the first and second polishing surfaces and a second cleaning surface between the second and third polishing surfaces so that the range of the predetermined distance S where one rotation in the circular motion crosses over different polishing surfaces is reduced, or so that one rotation in the circular motion does not cross over different polishing surfaces.

In this way, each polishing can be performed substantially on each polishing surface when the end surface of the workpiece is successively moved relative to the polishing film. Since the end surface of the workpiece passes over the cleaning surface first when it moves from one polishing surface to another, foreign matter or other debris do not move from one polishing surface to another, and it is thereby possible to achieve highly precise multi-stage polishing.

Each of the first and second cleaning surfaces has a length $Lc_1$, $Lc_2$ in the direction of linear movement, preferably, with $Lc_1$ and $Lc_2$ being equal to or greater than a radius R of the circular motion.

In this way, even when the predetermined distance, at which the workpiece is relatively and linearly moved, is relatively short, multi-stage polishing can be performed without reducing the desired amount of polishing on each polishing surface and without reducing polishing accuracy.

Alternatively, each of the first and second cleaning surfaces may have a length $Lc_1$, $Lc_2$ in the direction of linear movement, $Lc_1$ and $Lc_2$ being equal to or greater than the diameter 2 R of the circular motion. Accordingly, the end surface of the workpiece can be polished while abutting on the first polishing surface and subsequently cleaned while abutting on the cleaning surface, and then, polished while abutting on the second polishing surface, so that the polishing stages are performed more reliably.

The polishing film further comprises grooves arranged on both sides of the first and second cleaning surfaces. This makes it possible to remove fine polishing waste and other debris not only by the cleaning surface but also by the grooves, thereby increasing the cleaning effect.

The lengths of the first, second and third polishing surfaces in the direction of linear movement are greater than the diameter 2 R by l1, l2, and l3, respectively, each of the values of l1, l2, and l3 preferably being determined based on the desired polishing time for the first, second, or third polishing surface. This makes it possible to perform each polishing stage while controlling the contact time and the amount of polishing for each polishing surface.

When the end surface of the workpiece and the polishing plate are moved relative to each other, the workpiece may be fixed and the polishing plate may be circularly and linearly moved.

The polishing film is disposed on a surface of the polishing plate. Preferably, the shape and size of the polishing film are equal to that of the surface on which the film is placed. Thus, each polishing surface and each cleaning surface can be easily aligned with respect to the polishing locus by simply placing the polishing film on the surface aligned with the direction of linear movement.

According to the polishing method of the present invention, preferably, the polishing film and the surface on which it is placed are rectangular in shape so as to correspond to the polishing loci. The polishing film and the surface on which it is placed may form squares whose side lengths range from 140 mm to 150 mm. In this way, with the present invention, it is possible to perform multi-stage polishing by using polishing film suitable for an apparatus with a compact configuration.

The first, second and third polishing surfaces contain particles that differ from each other. The first and second cleaning surfaces each contain many flocked fibers on base materials. Preferably, when the end surface of the workpiece is brought into contact with the first, second, and third polishing surfaces and the first and second cleaning surfaces by a predetermined pressing force, the heights of the polishing surfaces and the cleaning surfaces are nearly equal to each other. This makes it possible to move the workpiece end face over the polishing film during polishing and cleaning.

The polishing film may further comprise one or more additional polishing surfaces. The one or more polishing surfaces may each be adjacent to the other polishing surface via one or more additional cleaning surfaces. This makes it possible to perform batch polishing even for such things as multi core optical fiber ferrules that require a greater number of polishing processes.

During polishing, the reference surface of the polishing apparatus may be inclined at a predetermined angle from the horizontal plane to supply water to the polishing film. This makes it possible to more surely prevent any impact on a subsequent polishing process from such things as polishing waste generated after polishing commenced.

Another embodiment of the present invention provides a polishing film used for performing multi-stage batch polishing on an end surface of a workpiece, the polishing being performed by moving the end surface of the workpiece and a polishing plate relative to each other in a circular motion with a radius R within a plane parallel to the reference plane and by linearly moving the center of the circular motion by a predetermined distance S while bringing the end surface of the workpiece into contact with the polishing film disposed on the polishing plate, the polishing film comprising first, second and third polishing surfaces, the length of each polishing surface in the direction of linear movement being equal to or greater than the diameter 2 R of the circular motion, the polishing film further comprising a first cleaning surface between the first and second polishing surfaces and a second cleaning surface between the second and third polishing surfaces so that the range of the predetermined distance S where one rotation in the circular motion crosses over different polishing surfaces is reduced, or so that one rotation in the circular motion never crosses over different polishing surfaces.

Preferably, the second polishing surface consists of an abrasive film provided with diamond particles having an average particle diameter of 1 μm. This makes it possible to form the surface properties required for subsequent finish polishing on the end surface of the workpiece, so that the polishing film is capable of collectively performing the polishing processes from rough polishing to finish polishing with a minimum number of polishing surfaces.

Preferably, the length of the first polishing surface in the direction of linear movement is in the range of 15 to 35 mm, that of the second polishing surface is in the range of 20 to 40 mm, and that of the third polishing surface is in the range of 50 to 80 mm, while the length in the direction of linear movement of the cleaning surface is in the range of 5 mm to 20 mm. Multiple stages including rough polishing, intermediate polishing, and finish polishing can be collectively performed by an appropriately sized polishing film.

Effects of the Invention

According to the polishing method and the polishing film of the present invention, multi-stage batch polishing and cleaning can be performed easily and with high precision on the end surface of a workpiece such as a single core optical fiber connector. The complexity of placing polishing films can be eliminated and the polishing process can be greatly improved.

In addition, according to the polishing method and the polishing film of the present invention, multiple polishing apparatuses and cleaning apparatuses are not required for performing multi-stage polishing, thereby eliminating the need for space to install such apparatuses and reducing costs. Polishing is performed by a designated polishing apparatus using polishing film that has polishing surfaces and cleaning surfaces, each with dimensions that suit the polishing locus and polishing process, thereby performing the desired workpiece surface polishing with a high degree of precision and fewer processes.

Polishing can be performed by the polishing apparatus through a series of operations, and therefore, it is easy to maintain uniform polishing from the beginning to the end and to prevent uneven results in the finished end surfaces of different workpieces.

BEST MODES FOR CARRYING OUT THE INVENTION

Figure 1:
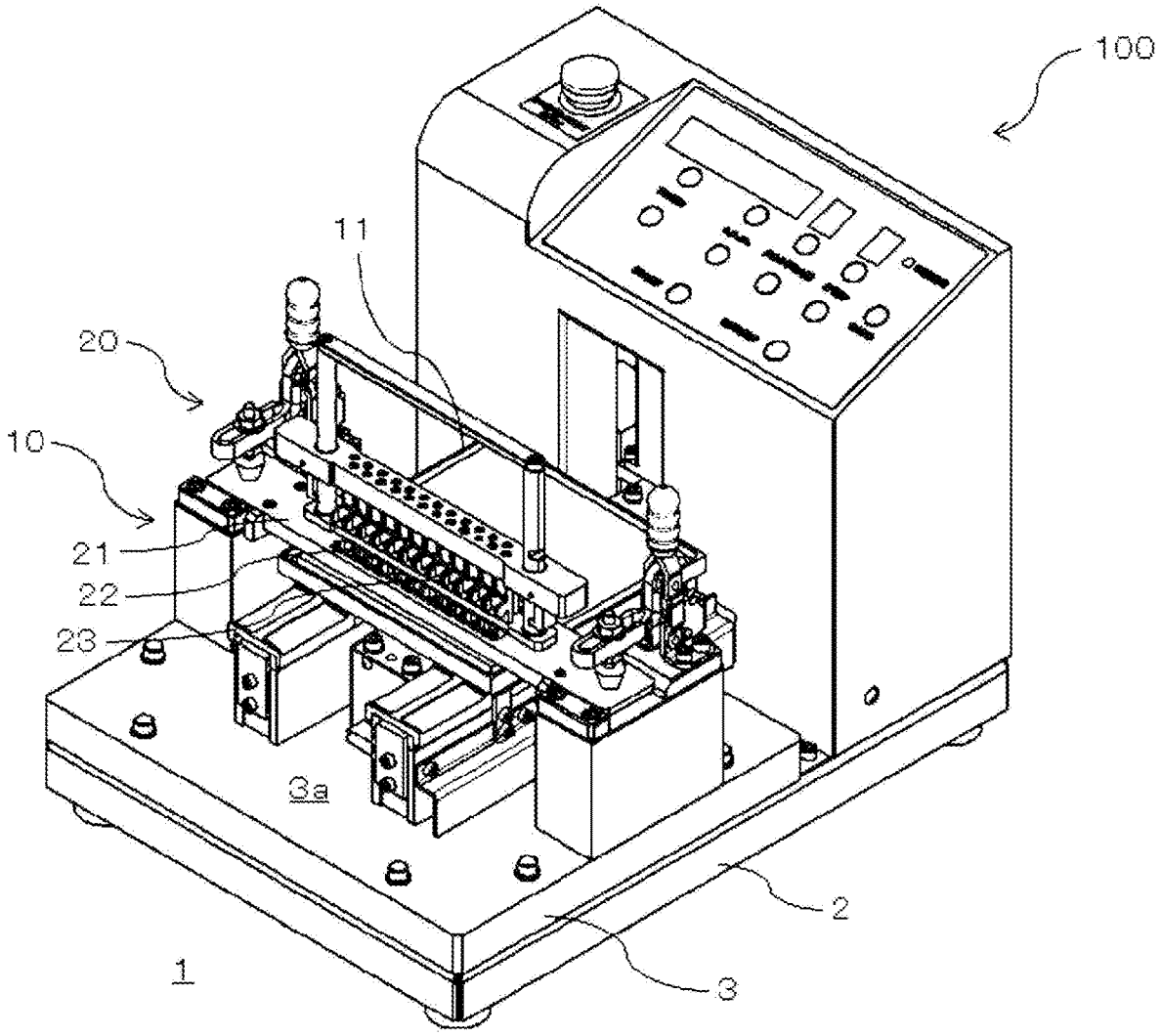
FIG. 1 shows the polishing apparatus for use in the polishing method of the present invention.

Hereinafter, preferred embodiments of the present invention will be described with reference to the drawings. The drawings are for explanation, in which dimensions such as thickness may be exaggerated. The scale of the drawings may vary. The same symbol may be used for a similar or corresponding component. The configurations described in the drawings are given by way of example and are not intended to limit the scope of the invention.

Figure 11:
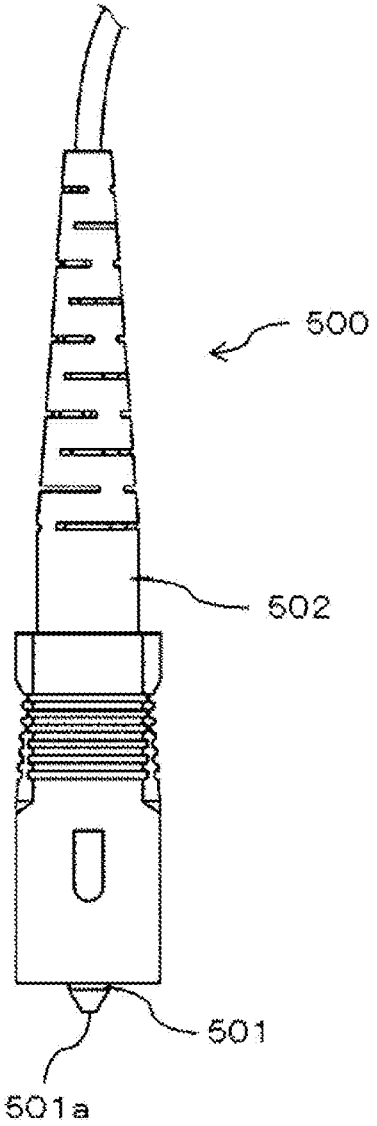
FIG. 11 shows an example of a single core optical fiber connector to be polished using the polishing method of the present invention.

FIG. 11 shows a workpiece 500 to be polished by the polishing method of the present invention. The workpiece is, for example, an optical fiber connector comprising an optical fiber ferrule 501 and plug housing 502. The end surface 501*a* of the optical fiber connector is polished.

A known polishing apparatus can be used as a polishing apparatus to polish the end surface 501*a* of the optical fiber connector, wherein polishing can be performed by bringing the end surface of the optical fiber connector and a polishing film disposed on a polishing plate into contact while moving them relative to each other. Such a polishing apparatus is disclosed in Japanese Patent No. 3773851 (patent document 4) and Japanese Patent No. 5714932 (patent document 5).

FIG. 1 shows a polishing apparatus 100 of an embodiment which is disclosed in patent document 5. The polishing apparatus 100 comprises a base 3 placed on a work floor surface 1 via a pedestal 2 incorporating vibration-proof rubber or the like. The base 3 is a plate-like member having a flat mounting surface (reference surface) 3*a*, and is preferably formed of a stone plate. The polishing apparatus 100 further includes a polishing unit 10 including a polishing plate 11 supported on the base 3 so as to be moved parallel to the reference surface 3*a*, and a work unit 20 for holding the optical connector end face which opposes the polishing plate 11, the work unit 20 being detachable from the polishing unit 10.

The work unit 20 includes a plate-like member 21 having multiple workpiece mounting holes 22, 22, . . . provided in a row and multiple pressing members 23, 23, . . . corresponding to the multiple workpiece mounting holes. Multiple optical fiber connectors are mounted on the multiple workpiece mounting holes, and then, the end surfaces of the optical fiber connectors are pressed against the polishing surface or the like on the polishing plate with a predetermined pressing force through corresponding pressing members 23.

Figure 2:
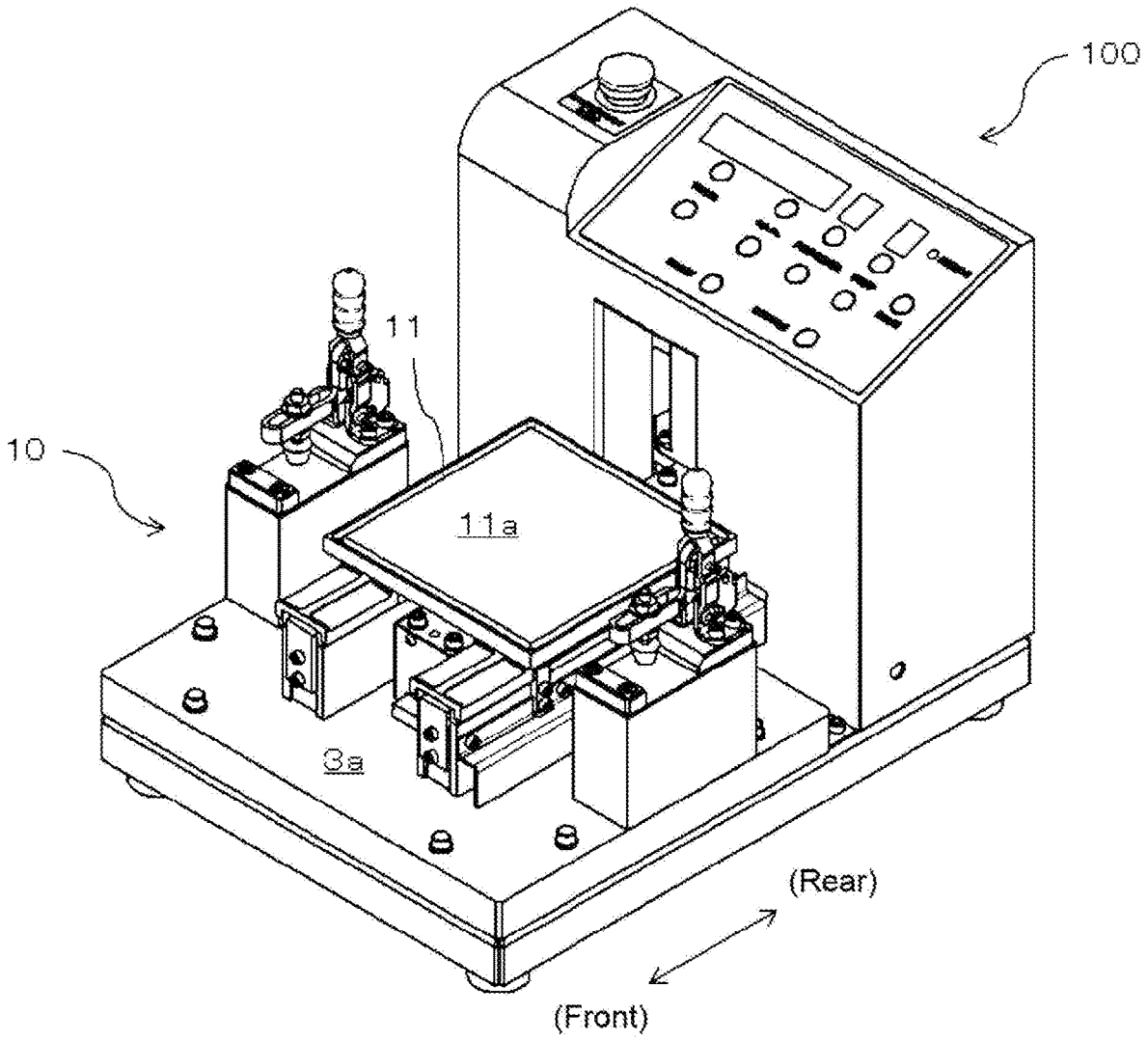
FIG. 2 shows the polishing apparatus for use in the polishing method of the present invention with the apparatus's work unit removed.

FIG. 2 shows the polishing apparatus 100 from which the work unit 20 has been removed. The polishing unit 10 comprises a polishing plate 11 comprising a placement surface 11*a* on which the polishing film with polishing surfaces is secured via an elastic sheet such as a rubber plate, and a known driving mechanism (not shown) such as a motor for generating the circular motion of the polishing plate 11 within a plane parallel to the reference surface 3*a* of the base and the linear movement of the polishing plate 11 in the back and forth direction (direction of the arrow). The surface 11*a* on which the film is placed is rectangular in shape with a predetermined longitudinal width (H) and lateral width (H').

Figure 3:
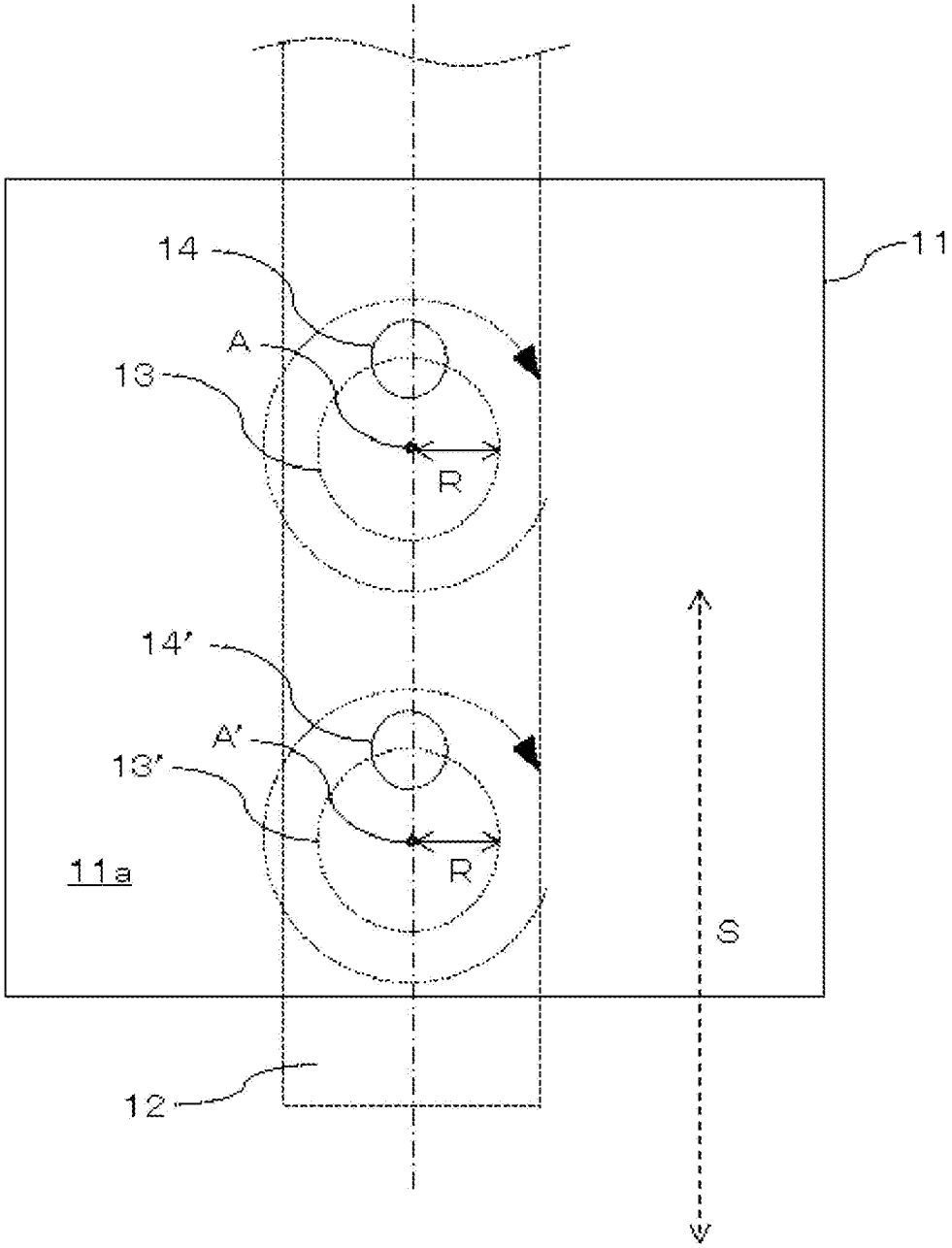
FIG. 3 schematically shows the driving mechanism for moving the polishing plate (placing surface).

Referring to FIG. 3, the polishing plate 11 is supported on the slider 12 via two eccentric pins 14, 14' of two rotation members 13, 13' rotatably supported by the slider 12. The eccentric pin 14 (14') is eccentric to the rotation axis A (A') of the rotation member 13 (13') by a predetermined distance R, the axis being perpendicular to the reference surface 3*a*. As the rotation member 13 (13') rotates around the rotation axis A (A') with the rotation driving mechanism, all the points on the polishing plate are rotated with a turning radius R around the rotation axis A (A') perpendicular to the reference surface 3*a*. Further, the slider 12 is moved linearly by a predetermined linear movement distance S with the linear movement driving mechanism.

Figure 4:
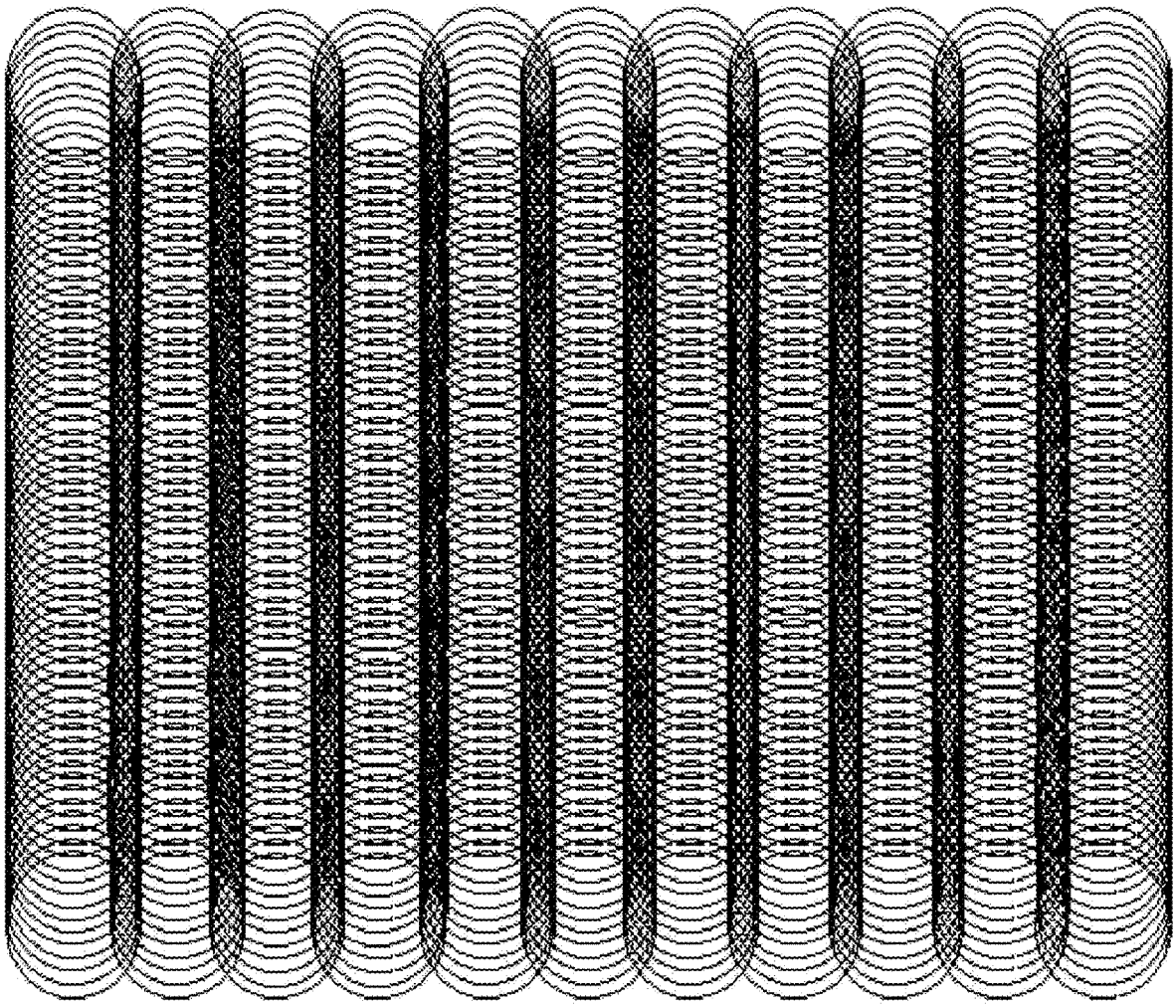
FIG. 4 shows the relative movement loci (polishing loci) of the workpiece end surfaces during polishing.

FIG. 4 schematically shows the polishing loci of multiple workpieces (11 workpieces in the illustrated example) arranged in the polishing apparatus 100. With such polishing loci, a rectangular polishing film can be effectively used to perform highly accurate polishing. As shown in the figure, for example, when the polishing plate 11 (placement surface 11*a*) linearly moves from the rear to the front while moving circularly, each workpiece moves linearly from the front to the rear while moving circularly relative to the polishing plate. The direction of linear movement of the polishing plate 11 may be a longitudinal direction, a lateral direction, or the like.

The shape of the pattern (circle or circular arc) and the number of patterns in the polishing locus of the workpiece W can be determined by the linear movement speed $V_1$ (mm/min) of the polishing plate 11 determined by the settings of the driving mechanism and the rotational speed $V_2$ (rpm) of the rotation member 13 (see FIG. 3). For example, as the linear movement speed $V_1$ is faster and the rotational speed $V_2$ is slower, the pattern of the polishing locus is made to be the shape of the Japanese letter "no" (の) as if the spring is extended, and the number of patterns decreases. The slower the linear movement speed $V_1$ and the faster the rotational speed $V_2$ become, the pattern of the polishing locus approaches the circle having a radius R related to the circular motion of the polishing plate 11, and the number of patterns increases.

The longer the distance of linear movement S becomes, the more the polishing locus and polishing amount can increase. However, it is undesirable for the space occupied by the polishing apparatus 100 to increase due to the linear distance S being too long. It is also undesirable for the polishing amount to become insufficient due to the linear distance S being too short. Therefore, it is preferable that the predetermined distance S is a required length for obtaining the desired polishing amount within the setting range of the linear movement speed $V_1$ and the rotational speed $V_2$ of the polishing plate 11.

According to the present invention, the polishing plate 11 moves linearly only in one direction by a predetermined distance during polishing. Accordingly, it is preferable that the linear movement speed $V_1$ is slow and the rotational speed $V_2$ is fast so as to obtain the desired polishing amount. Since the rotational speed $V_2$ is sufficiently higher than the linear movement speed $V_1$, the polishing locus of the workpiece W has circles compactly connected to each other in a straight line, each circle substantially having the radius R.

Figure 5A:
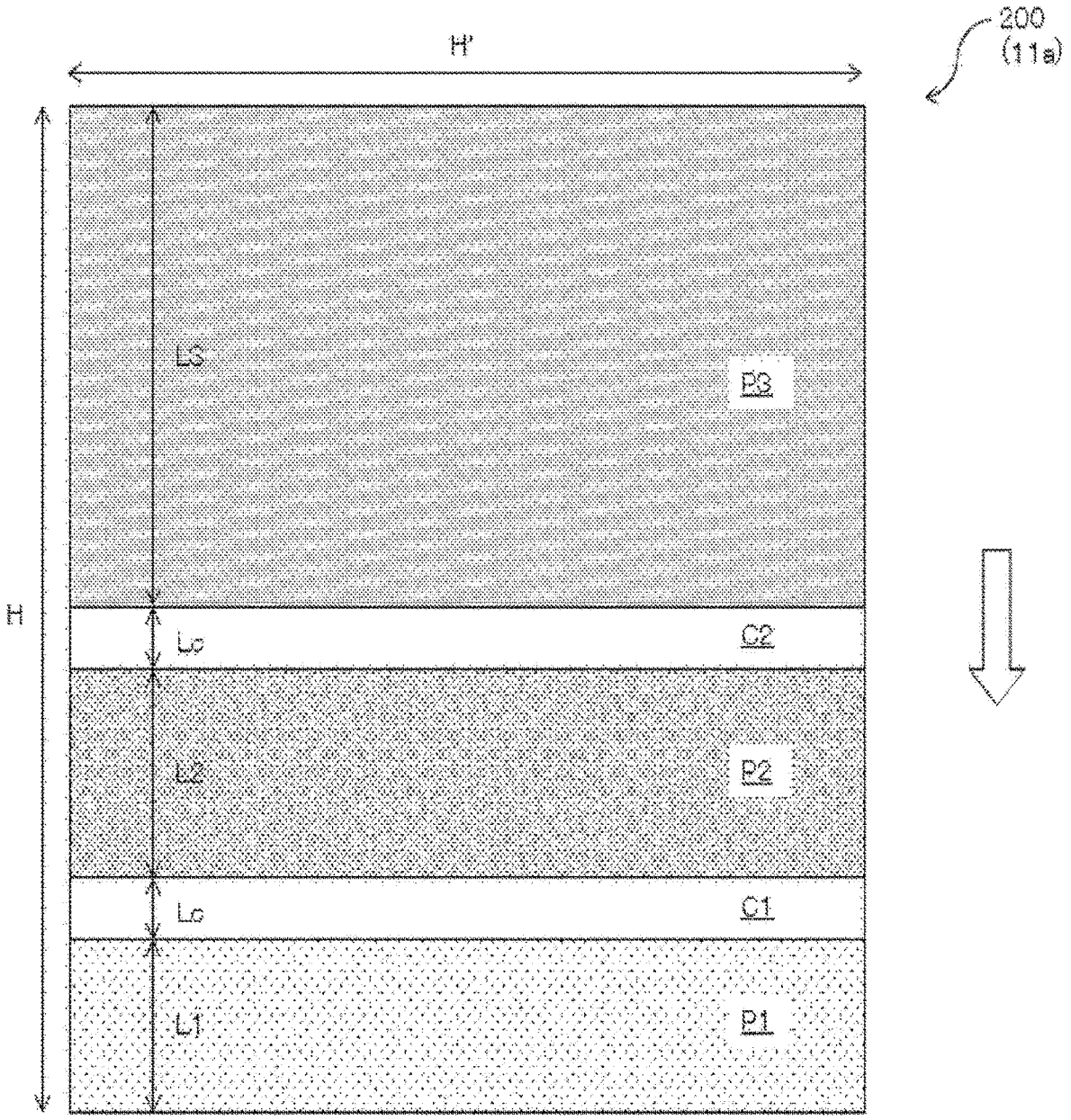
FIG. 5A shows a polishing film according to an embodiment of the present invention.

According to one embodiment of the present invention, FIG. 5A shows the polishing film 200 disposed on the placement surface 11*a*. The polishing film 200 has the same size and same shape as the surface 11*a* on which it is placed and has a rectangular shape with the same predetermined longitudinal width (H) and lateral width (H') as the surface 11*a*. The polishing film 200 includes a polishing surface P1 for rough polishing (break-in polishing and/or polishing for removing an adhesive), a polishing surface P2 for performing intermediate polishing, and a polishing surface P3 for finish polishing. Further, the polishing film 200 includes cleaning surfaces C1 and C2 between respective polishing surfaces for cleaning so that foreign matter is not left on the end surface of the connector, the foreign matter including polishing waste generated when the end surface of the workpiece W passes over each polishing surface and abrasive grains that have fallen off. Each polishing surface may consist of a different polishing film or the like provided with abrasive grains suitable for each polishing. The cleaning surfaces C1, C2 may consist of flocked film, woven fabric, nonwoven fabric, and/or foamed polyurethane and the like.

Regarding the polishing film 200, each of the polishing surfaces and cleaning surfaces is arranged according to the direction of linear movement of the polishing plate 11 (placement surface 11*a*). Namely, when the polishing plate 11 moves linearly from the rear to the front (direction shown by outlined arrow), the polishing surface P1, the cleaning surface C1, the polishing surface P2, the cleaning surface C2, and the polishing surface P3 are arranged in order along the opposite direction, that is, from the front to the rear.

Each polishing surface P1, P2, and P3 has a predetermined longitudinal width (length in the direction of linear movement) L1, L2, and L3. Each cleaning surface has a predetermined longitudinal width (length in the direction of linear movement) Lc. The longitudinal widths of cleaning surfaces C1 and C2 may be equal to each other. The longitudinal widths of the cleaning surfaces C1 and C2 may be different from each other.

Figure 5B:
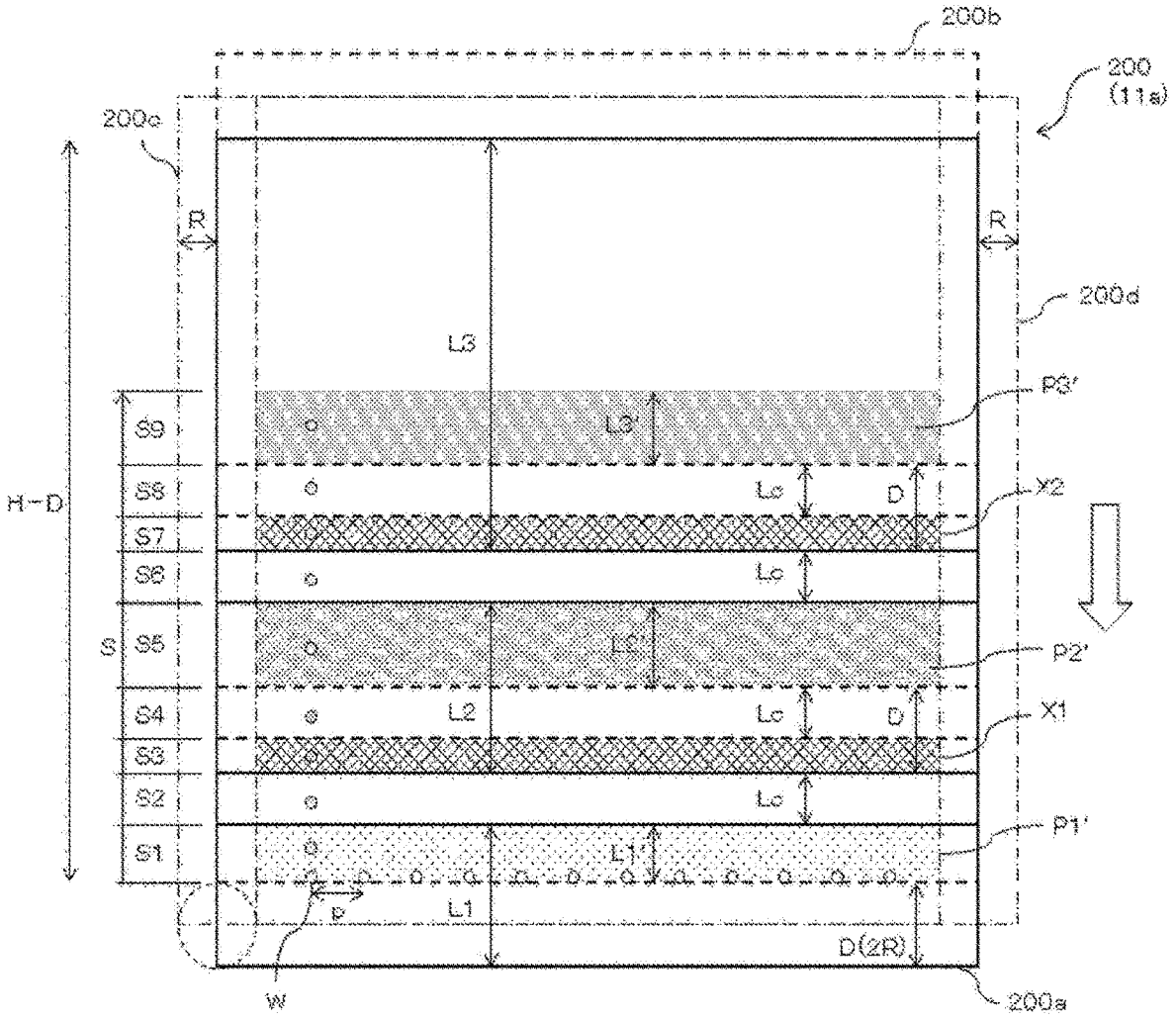
FIG. 5B schematically shows the relationship between the polishing state and the relative linear movement when using the polishing film according to the embodiment of the present invention.

Referring to FIG. 5B, each workpiece W (12 workpiece end surfaces are indicated by white circles, illustratively) is affixed to the work unit so as to abut on the polishing film 200 which is disposed on the surface 11*a*. The multiple workpieces Ws are arranged with a predetermined interval p in a direction orthogonal to the direction of linear movement (the right and left direction).

Preferably, the value of the radius R is not a multiple of the value of pitch p with which the workpieces are arranged in the lateral direction, and vice versa. This makes it possible to reduce or eliminate any overlapping of the polishing loci of the multiple workpieces so that the polishing surface can be effectively utilized and the effect of any foreign matter remaining on the polishing surface on the workpieces can be minimized.

When the polishing plate 11 is moved in a circular motion with the radius R, the polishing film 200 is also moved in a circular motion. Illustratively, the front, back, left and right positions of the polishing film 200 are indicated by 200*a*, 200*b*, 200*c*, and 200*d*, respectively. The position of each polishing and cleaning surface of the polishing film 200 is moved in the longitudinal direction by the diameter D (2 R) of the circular motion at the maximum. Further, when the surface 11*a* moves linearly toward the front of the polishing apparatus 100 by a predetermined distance S (≤H−D), the workpiece W moves to a rearward position with respect to the polishing film 200, the exemplary positions being indicated by light gray circles.

Multi-stage polishing is performed on the end surface of the workpiece W, such as a single core ferrule, so that a predetermined surface property is formed on the end surface at each stage and so that the end surface is finally finished into a mirror face. For example, rough polishing of a single core ferrule is performed in order to remove adhesives on the end surface and in order to bring the end surface into a state suitable for subsequent polishing. In finish polishing, since fine nanometer-level abrasive grains are used, only a limited amount of polishing is possible. Therefore, the intermediate polishing is performed as a preliminary process for finishing the end surface into a mirror face, for example, for removing fine scratches. The intermediate polishing is particularly important for reducing takt time.

In addition, the cleaning process is performed between each polishing process so that foreign matter such as polishing waste generated in the previous process does not remain on the end surface of the workpiece. If foreign matter adheres to the end surface of the workpiece, there is a risk that the foreign matter will be carried over to the subsequent polishing surface, making it difficult to perform the desired polishing.

According to the present invention, multi-stage batch polishing can be performed by successively moving the polishing plate and the end surface of the workpiece relative to each other in a circular and linear motion while adding a required surface property to the end surface of the workpiece at each polishing surface so that a highly accurate finished surface is finally obtained.

When the workpiece W moves linearly from front to rear relative to the polishing film 200 by the distance S, details of polishing (and cleaning) vary depending on the exemplary positions which are indicated by light gray circles. As shown, the end surface of the workpiece W is always located on the polishing surface P1 (rough polishing) within the range of distance S1 from the start of linear motion regardless of the rotation with the radius R of the polishing film 200. Accordingly, P1' can perform substantial rough polishing. In the range of S2, the end surface is located on P1 or on the cleaning surface C1 (rough polishing and cleaning). In the range of S3, the end surface is located on P1, C1, or on the polishing surface P2 (mixed polishing: X1). In the range of S4, it is located on C1 or P2 (cleaning and intermediate polishing). In the range of S5, it is always located on P2 (intermediate polishing). Accordingly, P2' can perform substantial intermediate polishing. In the range of S6, it is located on P2 or on the cleaning surface C2 (intermediate polishing and cleaning). In the range of S7, it is located on P2, C2 or on the polishing surface P3 (mixed polishing: X2). In the range of S8, it is located on C2 or P3 (cleaning and finish polishing). It is always positioned on P3 within the range of S9 (finish polishing). Accordingly, P3' can perform substantial finish polishing. That is, the end surface of the workpiece W is sequentially subjected to rough polishing, rough polishing and cleaning, mixed polishing of rough and intermediate polishing and cleaning, intermediate polishing and cleaning, intermediate polishing, intermediate polishing and cleaning, mixed polishing of intermediate and finish polishing and cleaning, finish polishing and cleaning, and finish polishing.

The above distance S of the linear movement corresponds to the distance by which the center of the rotation of each workpiece moves according to the polishing locus as shown in FIG. 4.

As described above, during the relative movement between the placement surface 11*a* on which the polishing film is placed (polishing film 200) and the workpiece, the end surface of the workpiece W initially contacts only P1 before it comes into contact with not only P1 but also the cleaning surface C 1, and then, depending on the longitudinal width of C 1, it repeatedly and alternately contacts P1 and P2 via C1 (mixed polishing X1).

When the workpiece W is alternately brought into contact with the polishing surface P1 (P2) and the polishing surface P2 (P3) (mixed polishing X1, X2), the desired surface property cannot always be formed on the workpiece due to the transfer of polishing waste generated on one polishing surface to the next polishing surface, or due to polishing being performed alternately on different polishing surfaces. The cleaning surface C1 (C2) may be arranged so as to eliminate or reduce such mixed polishing, or so as to sufficiently remove polishing waste which may be generated on the previous polishing surface from the workpiece end surface, thereby allowing the subsequent polishing surface to perform polishing with high precision.

As shown in the drawings, the range of the linear movement distance S where the workpiece abuts on the cleaning surface C1 (C2), except for the range where the workpiece abuts only on any one of the polishing surfaces (that is, P1', P2' or P3'), is a length obtained by adding the longitudinal width ($L_c$) of C1 (C2) to the diameter D of the circular motion. If the length becomes too long, the ratio of the range to the linear movement distance S becomes too large, with the undesirable result of a reduction in the effective polishing range ratio of each polishing surface (P1', P2' or P3'). Alternatively, if the range where the workpiece abuts on the cleaning surface is too short, the end surface of the workpiece W may not be cleaned sufficiently, with the undesirable result of decreased polishing accuracy on each polishing surface.

Here, the range of the linear movement distance S of the mixed polishing X1 (X2) (S3 and S7) can be shown by the length (D−Lc) obtained by subtracting the longitudinal width of the cleaning surface (Lc) from the diameter of the circular motion (D). The difference between the diameter D and the longitudinal width Lc of the cleaning surface represents the range of the linear movement distance S where mixed polishing is performed. In other words, the range of the linear distance S where mixed polishing is performed is reduced by the longitudinal length Lc of the cleaning surface related to the diameter D of circular motion.

In one embodiment of the present invention, the longitudinal width Lc of the cleaning surface C1 or C2 is greater than or equal to the radius R of the circular motion. This makes it possible to reduce the range of mixed polishing to a length equal to or less than R. Even when the linear movement distance of the surface 11*a* is relatively short, each polishing surface P1, P2 or P3 can perform high precision polishing.

Figure 8A:
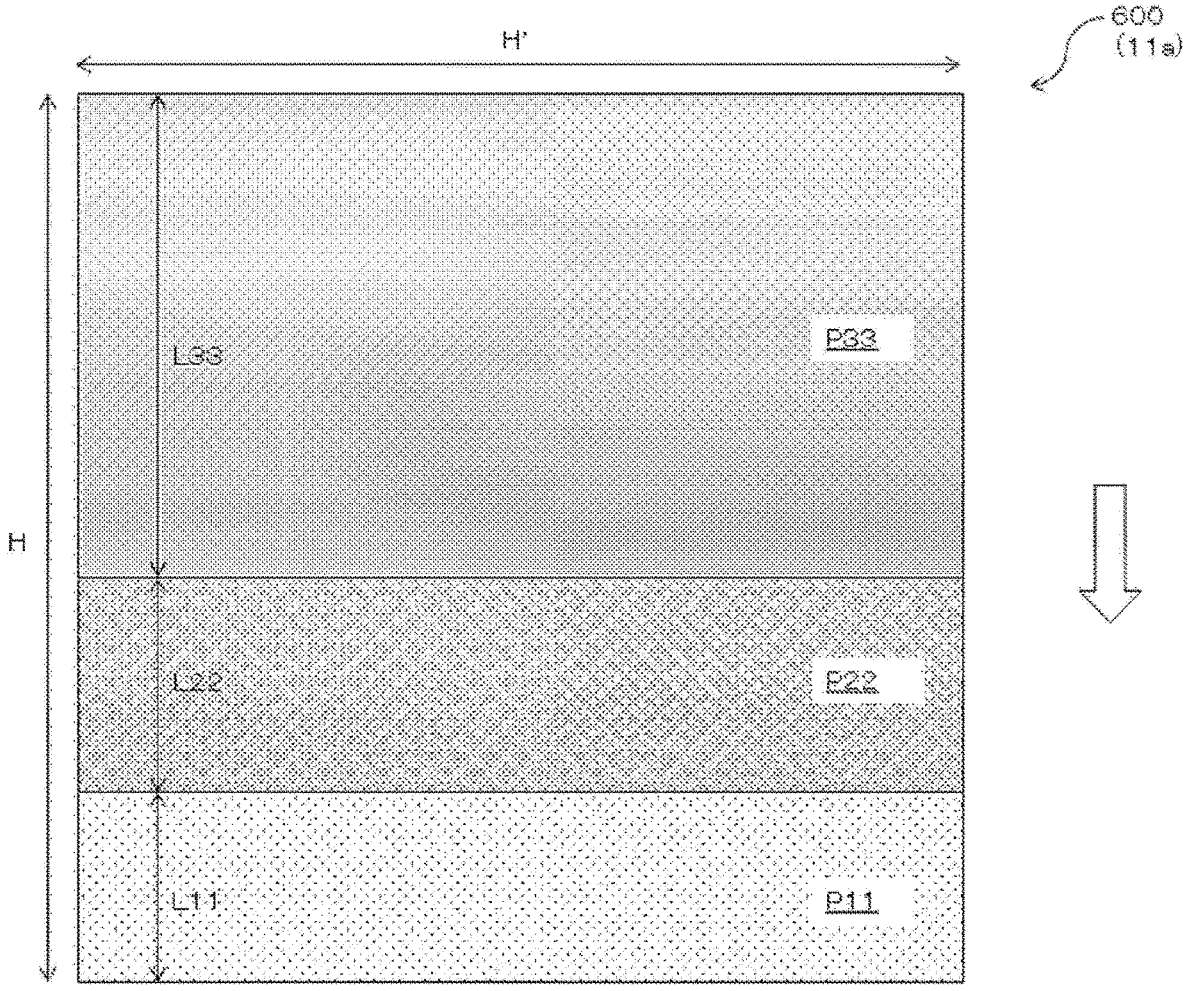
FIG. 8A shows a polishing film of a comparative example.
Figure 8B:
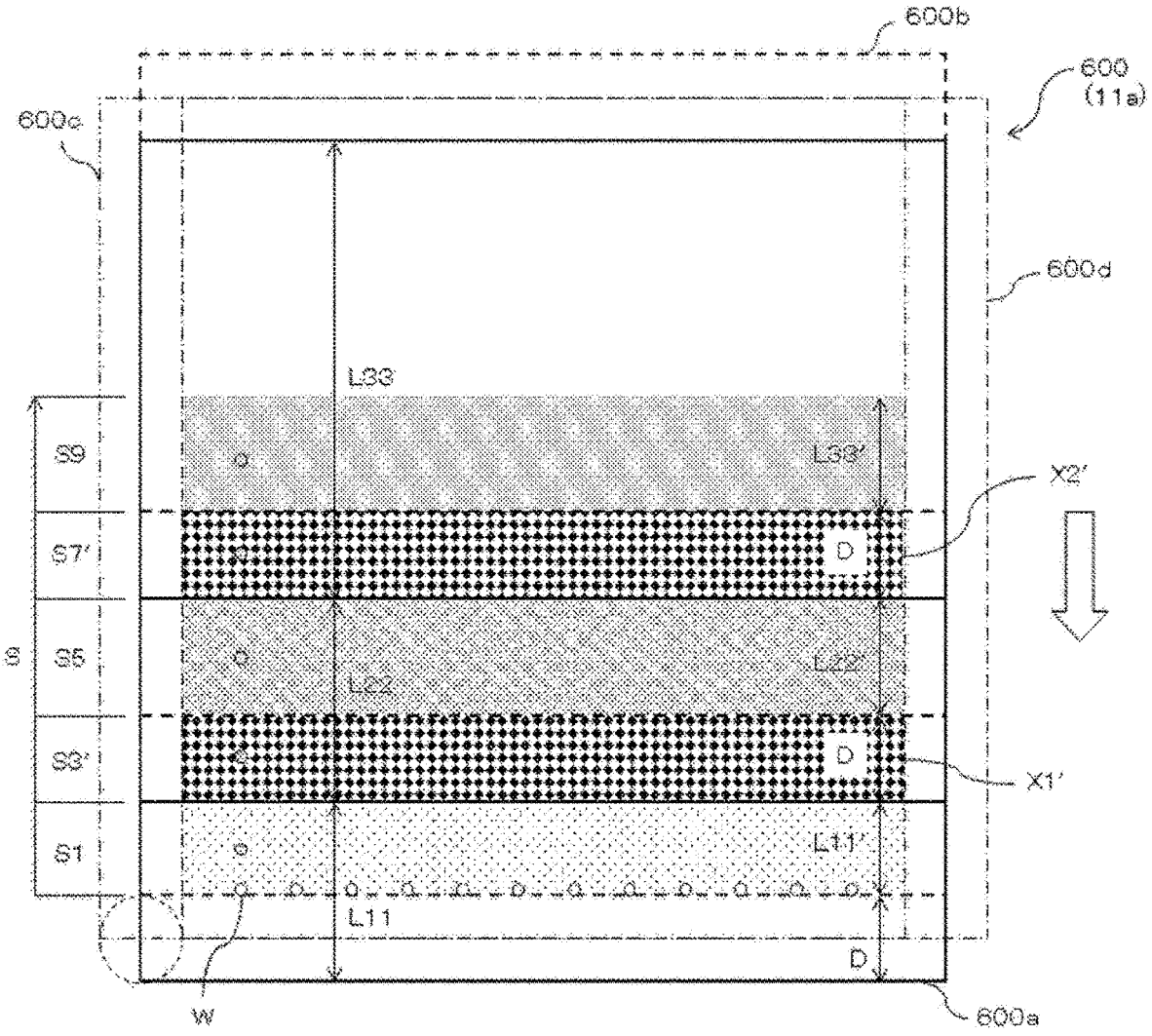
FIG. 8B schematically shows the relationship between the polishing state and the relative linear movement when using the polishing film of the comparative example.

For comparison, FIG. 8A shows a polishing film 600 having different polishing surfaces simply positioned side by side. FIG. 8B schematically shows the state of polishing when the polishing film 600 is used while being rotated and moved linearly relative to the workpiece. As shown in FIG. 8B, since the polishing film 600 does not have a cleaning surface, the range X1' or X2' (S3' or S7') in which the workpiece alternately contacts different polishing surfaces is represented by the length of the diameter D of the circular motion. In the range of X1' or X2', foreign matter generated on one polishing surface tends to contaminate a subsequent polishing surface since the workpiece abuts on different polishing surfaces without going through a cleaning surface. As described above, if a cleaning surface is not provided or if the longitudinal width of the cleaning surface is too short (for example, Lc<R), the end surface of the finished workpiece, such as a single core ferrule, may not satisfy the working specifications, resulting in yield degradation.

Referring to FIG. 5B again, the polishing corresponding to each polishing surface P1, P2, or P3 is substantially performed in the range of P1', P2', or P3'. Preferably, the dimensions of P1, P2 and P3 (L1, L2 and L3) may be determined to control the range of P1', P2', P3' (L1', L2', L3') so as to achieve the desired polishing amount on each polishing surface.

For example, if the length L1 of P1 is equal to the diameter D of the circular motion, there is a risk that polishing on P1 can be substantially performed at only one point of the linear movement distance, resulting in a failure to achieve the desired polishing.

Preferably, the longitudinal widths L1, L2 and L3 of the respective polishing surfaces P1, P2 and P3 are greater than the diameter D. Lengths L1', L2' and L3', by which L1, L2 and L3 are greater than the diameter D, respectively, can be determined based on the desired machining time ratio a:b:c for each polishing surface P1, P2, P3. The desired machining time ratio can be determined based on the machining time of conventional rough polishing, intermediate polishing, and finish polishing. For example, rough polishing:intermediate polishing:finish polishing=1:1~4:1~3. If the conventional rough polishing time is 40 seconds, intermediate polishing time is 120 seconds, and finish polishing time is 60 seconds, the time ratio can be as follows: rough polishing:intermediate polishing:finish polishing=1:3:1.5. The machining time ratio can be arbitrarily determined depending on the type of polishing film constituting each polishing surface, depending on the material and type of single core ferrule to be polished.

L1':L2':L3'=al:bl:cl (l is an arbitrary positive value) may be provided based on the machining time ratio a:b:c. As shown in FIG. 5B, (a+b+c) l+2 Lc+2 D=S, L1=L1'+D, L2=L2'+D, L3=H−(L1+L2+2 Lc). With the given a, b, c, Lc, D, S, and H, the polishing film 200 can be obtained, the film being sized and aligned so as to collectively perform multiple stages of polishing using the polishing apparatus 100.

Figure 6A:
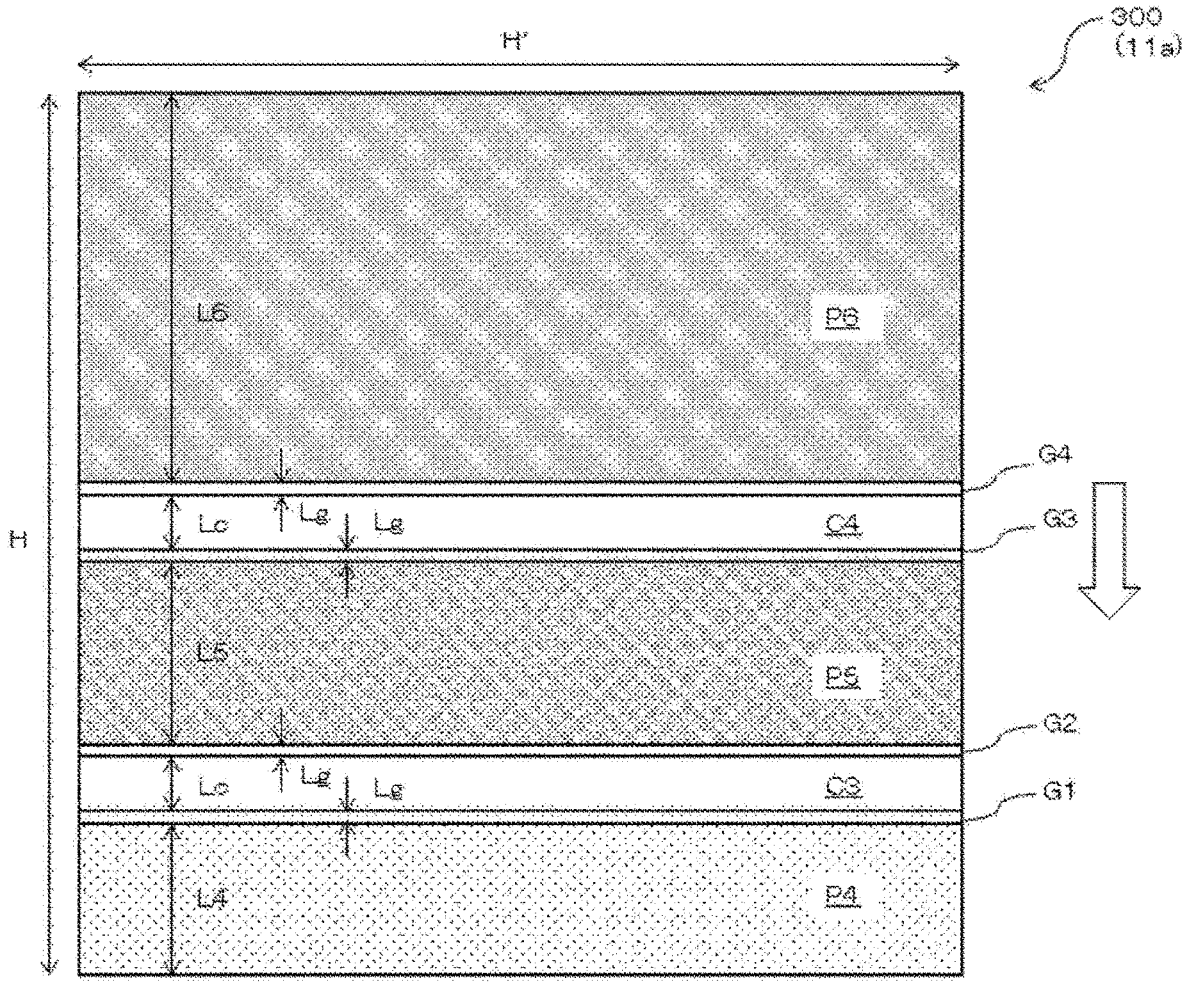
FIG. 6A shows a polishing film according to another embodiment of the present invention.

FIG. 6A shows a polishing film 300 according to another embodiment of the present invention. Like the polishing film 200, the polishing film 300 has multiple polishing surfaces P4, P5, P6, and cleaning surfaces C3, C4. The film further has small gaps (grooves) G1, G2, G3, and G4 between each of the polishing surfaces and the cleaning surfaces. Foreign matter such as polishing waste can be retained more accurately with such gaps (grooves). By arranging G1, G2, G3, and G4 on both sides of the cleaning surface, a cleaning effect similar to that of widening the longitudinal width of the cleaning surface can be expected, thereby improving accuracy in subsequent polishing.

Preferably, the longitudinal width of the groove (the length in the direction of linear movement: Lg) is determined so as not to prevent smooth movement of the end surface of the workpiece W. Preferably, for example, it is sufficiently smaller than the end face diameter of the workpiece W. If the single core ferrule has an end face diameter of 2 mm, the longitudinal width Lg of each groove may be 1.5 mm or less, 1 mm or less, 0.5 mm or less, 0.1 mm or less, or the like. The longitudinal widths (Lgs) of the grooves may be equal to each other. The longitudinal widths may be different from each other.

Figure 6B:
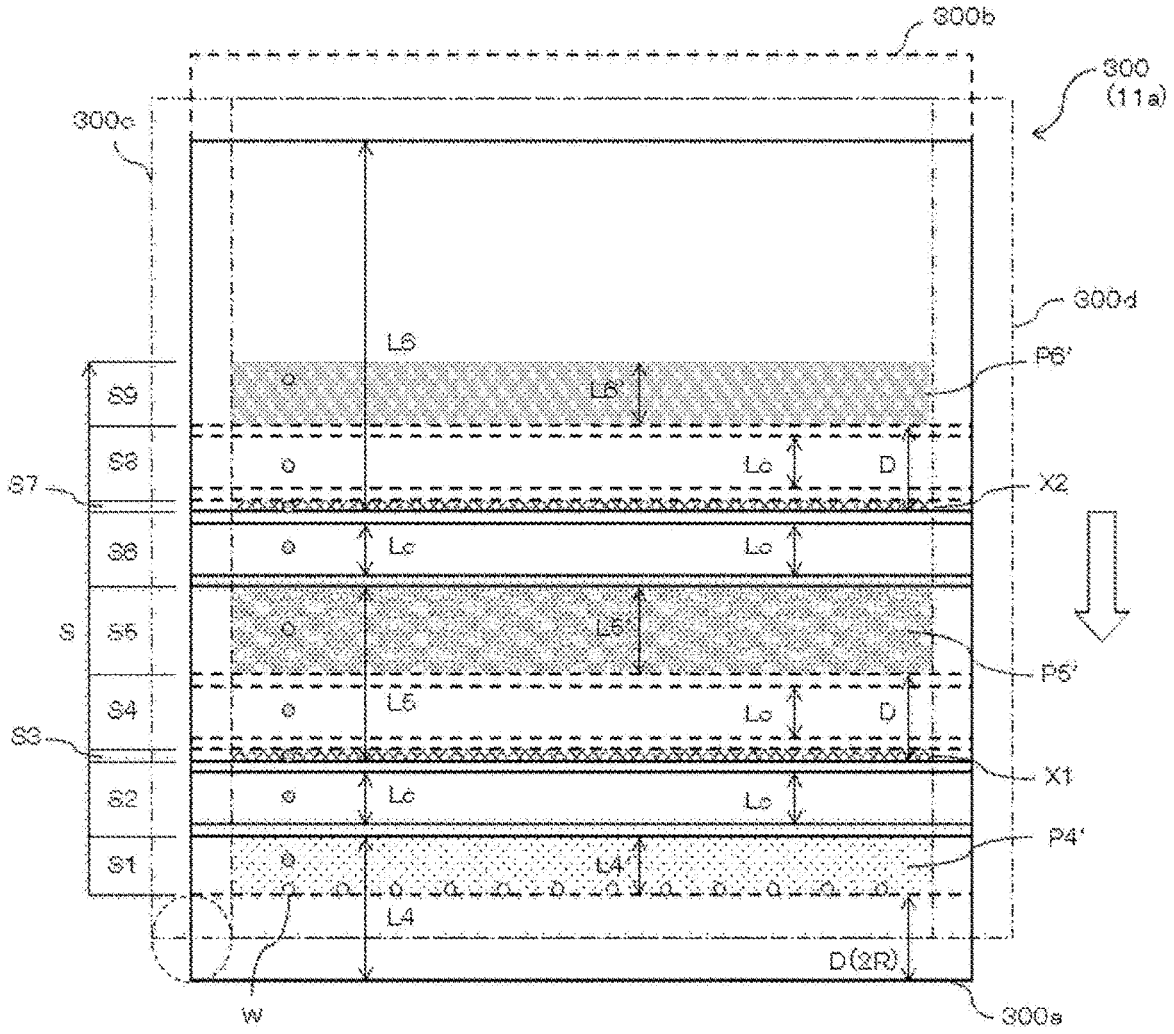
FIG. 6B schematically shows the relationship between the polishing state and the relative linear movement when using the polishing film according to another embodiment of the present invention.

As shown in FIG. 6B, similar to above, L4': L5': L6'=dl:el:fl (l is an arbitrary positive value) may be obtained based on the machining time ratio d:e:f for each polishing surface P4, P5, P6. With (d+e+f') l+2 Lc+2 D+4 Lg=S, L4=L4'+D, L5=L5'+D, L6=H−(L4+L5+2 Lc+4 Lg) and the given d, e, f, Lc, D, Lg, S, and H, the polishing film 300, sized and aligned according to rotation and linear movement of the surface on which it is placed, is obtained so as to collectively perform multi-stage polishing.

Figure 7A:
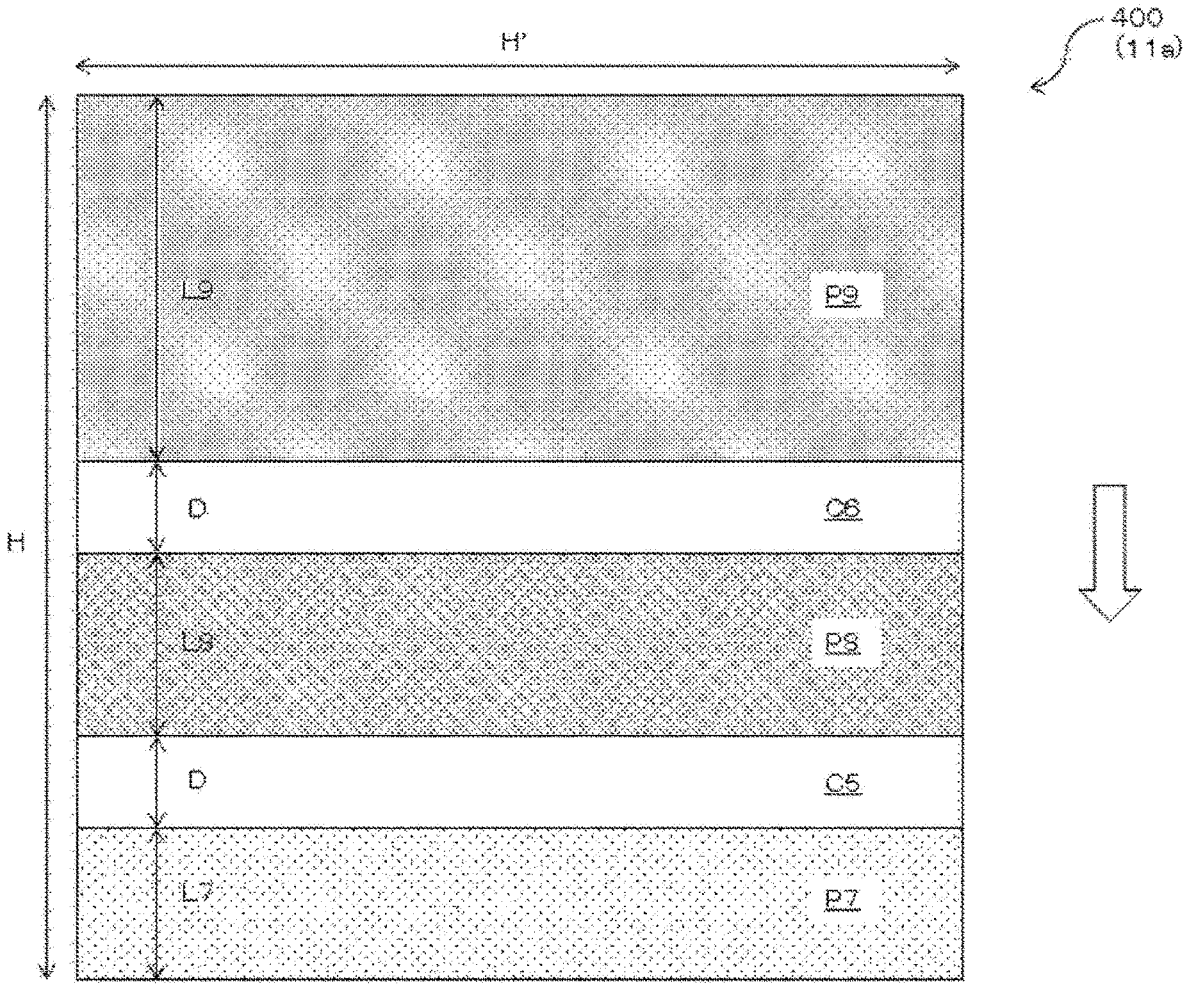
FIG. 7A shows a polishing film according to a further embodiment of the present invention.

FIG. 7A shows still another embodiment of the present invention. The polishing film 400 has the same size and the same shape as the surface 11*a* on which it is placed, and has a rectangular shape having a predetermined longitudinal width (H) and a lateral width (H') similar to the surface 11*a*. Similar to the polishing film 200, the polishing film 400 is provided with a polishing surface P7 for rough polishing, a polishing surface P8 for intermediate polishing, and a polishing surface P9 for finish polishing. Further, cleaning surfaces C5 and C6 are provided between respective polishing surfaces. The cleaning surfaces C5 and C6 have lengths along the direction of linear movement equal to or more than the diameter D (2 R) of the circular motion of the surface 11*a*, thereby preventing mixed polishing.

Figure 7B:
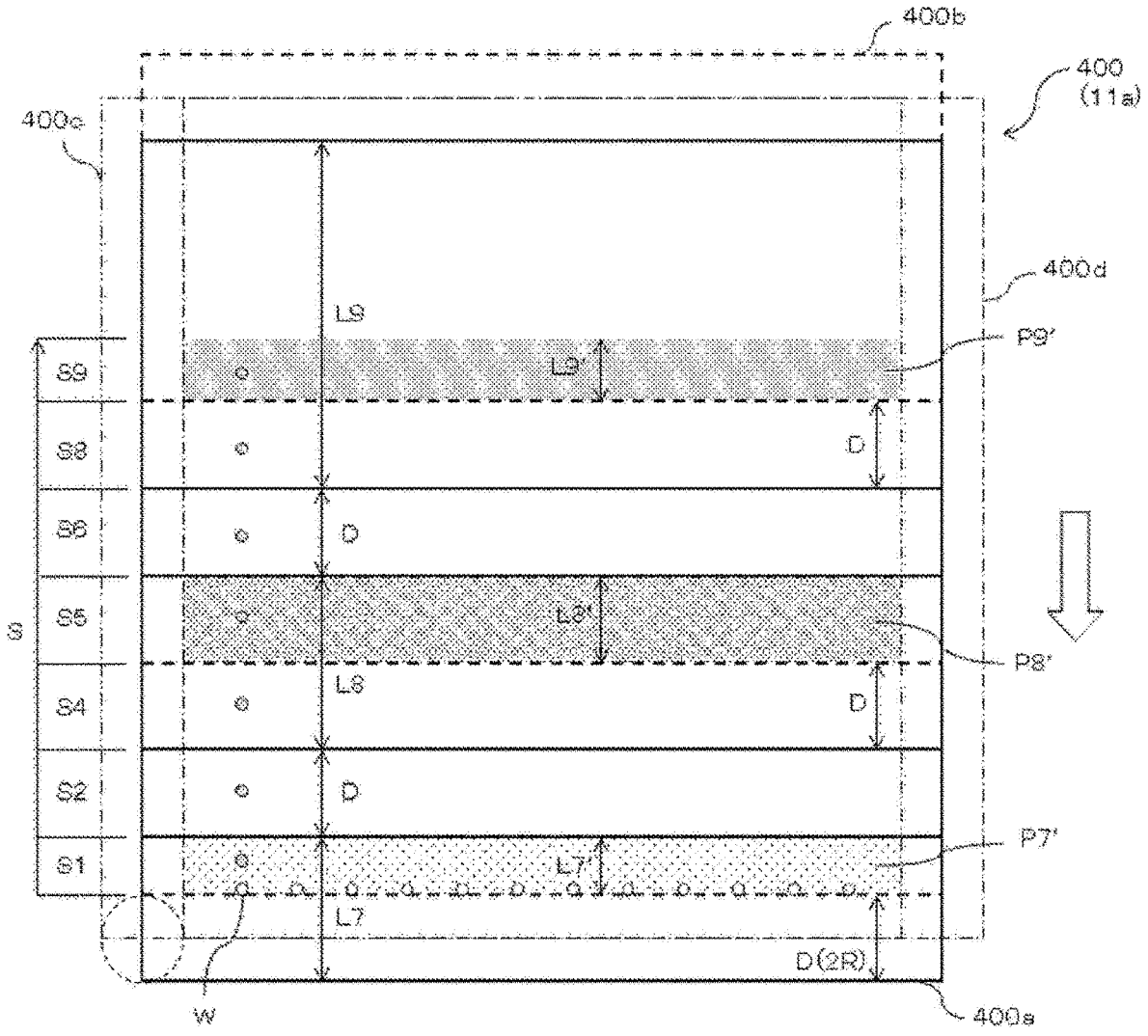
FIG. 7B schematically shows the relationship between the polishing state and the relative linear movement when using the polishing film according to a further embodiment of the present invention.

Referring to FIG. 7B, when the placement surface 11*a* moves linearly by a predetermined distance S(≤H−D) toward the front of the polishing apparatus 100 (the direction shown by the void arrow), the workpiece W gradually moves backward relative to the polishing film 400 to the exemplary positions shown by light gray circles. The end surface of the workpiece W is always positioned on the polishing surface P7 during linear movement within a distance S1 from the start (rough polishing: P7'). In the range of S2, it is located on P7 or C5. There is no range of mixed polishing (S3). In the range of S4, it is located on C5 or on the polishing surface P8. In the range of S5, it is always located on P8 (intermediate polishing: P8'). In the range of S6, it is located on P8 or on the cleaning surface C6. There is no range of mixed polishing (S7). In the range of S8, it is located on C6 or P9. It is always located on P9 within the range of S9 (finish polishing: P9').

In this manner, by making the longitudinal width of the cleaning surface equal to the diameter of circular motion of the polishing plate 11 or making it greater than the diameter, the end surface of the workpiece W will be prevented from alternately contacting different polishing surfaces (mixed polishing) during one rotation of the polishing plate. In other words, one circle of the polishing locus will not pass different polishing surfaces. In this way, more reliable cleaning can be performed, thereby improving the accuracy of subsequent polishing.

L7': L8': L9'=gl:hl:il (l is an arbitrary positive value) may be obtained based on the machining time ratio g:h:i for each polishing surface P7, P8, P9. With (g+h+i)l+4 D=S, L7=L7'+D, L8=L8'+D, L9=H−(L7+L8+2 D) and the given g, h, i, D, S, and H, the polishing film 400, sized and aligned according to the rotation and linear movement of the surface on which it is placed, is obtained so as to perform multi-stage batch polishing.

Depending on the object to be polished or the desired polishing accuracy, the longitudinal width Lc of the cleaning surface may be smaller than the radius R. When performing batch polishing on the object which does not require such high polishing accuracy, the linear movement distance may be shortened, thereby making the polishing apparatus more compact. In addition, the longitudinal width Lc of the cleaning surface may exceed the diameter D of circular motion. The amount by which the width is exceeded can correspond to the range on the linear movement distance where only cleaning is performed. Such width will be advantageous when more precise cleaning is required during polishing and when the linear movement distance can be sufficiently lengthened in the polishing apparatus.

The dimension of the longitudinal width of each polishing surface may be calculated by an alternative method without being limited to the one described above. The position in which the workpiece end face is fixed at the start of polishing is not limited to that of the above example and may be located more rearward on the surface 11*a*. In this case, the longitudinal width of the polishing surface corresponding to rough polishing may be longer. The dimension of the longitudinal width of each polishing surface can be determined in accordance with any calculation method or by any empirical method as long as the desired surface property is achieved on each polishing surface and/or as long as an end surface that satisfies the working specifications can finally be obtained according to the polishing locus.

It is described in the above that, in the polishing apparatus, the workpiece is fixed and the polishing plate 11 is moved circularly and linearly. However, the work unit may be moved circularly and linearly and the polishing plate may be fixed. Alternatively, the work unit may perform linear or circular motion, and the polishing plate may perform circular or linear motion.

Furthermore, although a polishing film with three polishing surfaces has been described, the number of polishing surfaces is not limited to the above. The number of polishing surfaces can be arbitrarily set according to the number of polishing steps, such as 2, 4, 5, 6, etc. Also, the number of cleaning surfaces can be arbitrarily set.

Figure 9A:
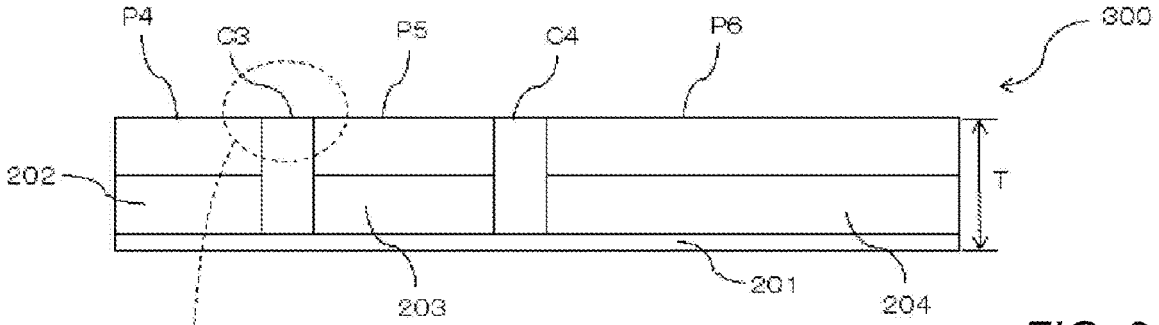
FIG. 9A is a schematic cross-sectional view of the polishing film.

FIG. 9A schematically shows a cross section of the polishing film 300. Each of the polishing surfaces P4, P5, P6, and the cleaning surfaces C3, C4 of the polishing film 300 is formed by laminating an existing polishing film or cleaning film being slit to a predetermined dimension onto a base film 201. The polishing surfaces P4, P5 and P6 consist of polishing films having different abrasive grains for rough polishing, intermediate polishing and finish polishing, respectively. Cleaning surfaces C3 and C4 are each composed of a flocked film including a base material and a flocked portion protruding from the base material. The cleaning surfaces C3 and C4 may be composed of the same flocked film or the like and may be composed of mutually different flocked films.

Preferably, the thickness (height) T of the polishing film 300 is substantially uniform between different polishing surfaces and cleaning surfaces. Therefore, each film may be laminated on the base sheet 201 using base materials 202, 203, 204, etc. to adjust for height, if necessary.

The polishing film 200 can be prepared by applying adhesives on the base film 201 and affixing to this base the polishing films, flocked films and height-adjusting base films if any, each of which has been slit to a predetermined size and positioned with a registration jig. The manufacturing method is not limited to this and can be arbitrarily selected.

Figure 9B:
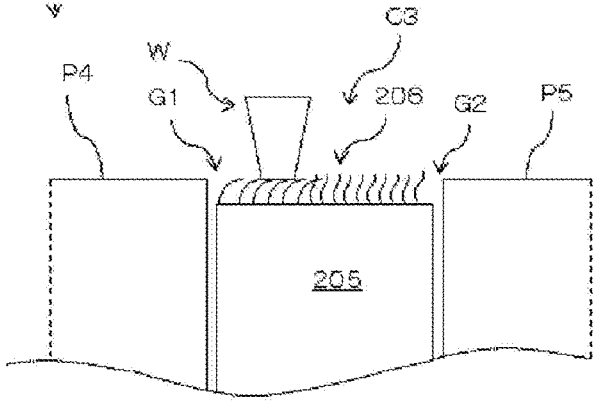
FIG. 9B is a partially enlarged view of FIG. 9A.

FIG. 9B schematically shows a partially enlarged cross section of the polishing film 300. Microscopically, the thickness (height) of the base portion 205 of the cleaning surface (C3, etc.) is slightly lower than that of each polishing surface (P4, P5, etc.). In this way, the end surface of the workpiece does not come into contact with the base portion 205, but contacts only the flocked portion 206 during cleaning. The size, material, density, etc. of the fibers constituting the flocked portion 206 are adjusted so that the flocked portion 206 has the same height as the previous and subsequent polishing surfaces while being bent by being brought into contact with the end surface of the workpiece W with a predetermined pressing force.

The abrasive grains used for each polishing film can be, for example, inorganic particles, including alumina ($Al_2O_3$), silica ($SiO_2$), diamond (single crystal, polycrystal), boron nitride (cBN), silicon carbide (SiC), and cerium oxide ($CeO_2$) as well as organic particles, including a crosslinked acrylic resin, a crosslinked polystyrene resin, a melamine resin, a phenol resin, an epoxy resin, a urea resin, and a polycarbonate resin.

The polishing film constituting each polishing surface can be a polishing film formed by fixing the above-described abrasive grains to the surface of a base film with a binder resin. The abrasive grains may protrude from the binder resin, the edges of the abrasive grains being made flush with one another. Alternatively, the edges may be covered with the binder resin. The surface of each polishing film is flat and the arithmetic average roughness (Ra) of the surface is preferably in the range of 0.01 μm to 3 μm.

The polishing film for rough polishing may comprise alumina particles having 5 μm to 20 μm average grain size, the polishing film for intermediate polishing may comprise diamond particles having 0.25 μm to 3 μm average grain size, and the polishing film for finish polishing may comprise silica particles having 0.01 μm to 0.2 μm average particle diameter.

In the batch polishing according to the present invention, since each stage of polishing is performed within the limited range of linear movement of the polishing plate, the surface property suitable for subsequent polishing should be formed on the end surface of the workpiece in the previous polishing. Particularly, it is important to form the desired surface property during the intermediate polishing before finish polishing. For example, when performing rough polishing with alumina particles or the like having a relatively large particle diameter and performing finish polishing with silica particles having a nano-size particle diameter, it is preferable to use diamond particles having about 1 μm average particle diameter for intermediate polishing. By appropriately configuring each polishing surface, batch polishing from rough polishing to finish polishing can be performed with a relatively short linear movement distance while minimizing the number of polishing surfaces, thereby making the polishing apparatus compact and shortening the polishing process.

The binder resin for fixing the abrasive grains may include but is not limited to an ultraviolet curable resin, an electron beam curable resin, a visible light curable resin, a thermoset resin, a thermoplastic resin, and a mixture thereof.

The binder resin may be an ultraviolet curable resin including, preferably, a photoinitiator, a sensitizer, epoxy resin, polyester resin, urethane resin, epoxy acrylate, polyester acrylate, urethane acrylate, silicon acrylate or a mixture thereof.

A plastic base material made of a synthetic resin can be used as the base film 201, the height-adjusting base film 202, 203 or 204, and the base material of each polishing film so as to provide the required resistance to, for example, rupture by mechanical force during polishing and deformation by heating during manufacturing (high strength, heat resistance), and flexibility.

Examples of the plastic base material include a film comprised of polyester resins such as polyethylene terephthalate, polybutylene terephthalate and polyethylene naphthalate, polyolefin resins such as polyethylene and polypropylene, polystyrene, vinyl chloride, polyvinyl alcohol, acrylic resin containing methacrylic alcohol as a main component, or polycarbonate, etc. The thickness is preferably in the range of 5 μm or more and 500 μm or less, particularly in the range of 10 μm or more and 200 μm or less, but is not limited thereto.

A flocked film in which nylon fibers or the like are flocked on a flexible base film, the height of the fibers being made uniform, can be used as the cleaning surface. A woven fabric or a plastic film sheet can be used as the flexible base film. Preferably, the plastic film sheet is used as the flexible base film. Examples of the plastic film sheet include polyethylene terephthalate, polyethylene naphthalate, polyphenylene sulfide, polyether imide, polyimide, polycarbonate, polyvinyl chloride, polypropylene, polyvinylidene chloride, nylon, polyethylene, or polyether sulfone film sheet.

Flock may consist of nylon, polypropylene, polyethylene, polyethylene terephthalate, polyurethane, acrylic, polyvinyl chloride, vinylon or rayon fiber, glass fiber, carbon fiber or metal fiber. Preferably, the thickness of the flock is in the range of 0.1 to 10 d, its length is in the range of 0.1 to 1.0 mm, and its density is in the range of 20 to 100 g/m$^2$. Particles of 0.01 to 2 μm may be fixed to the flock.

Figure 10:
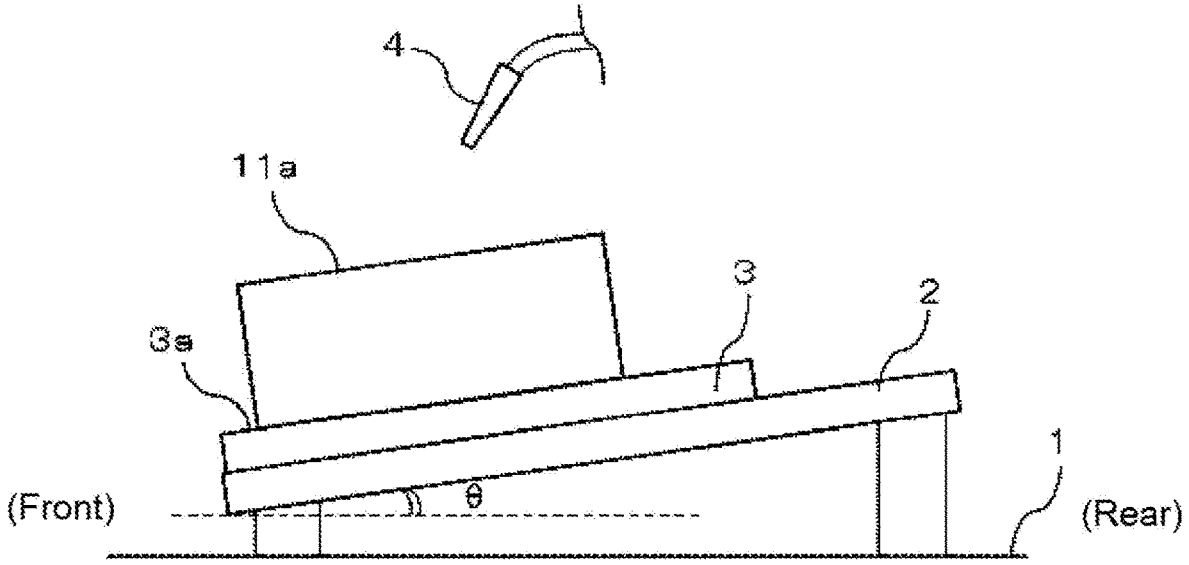
FIG. 10 schematically shows one embodiment of usage of the polishing apparatus in the polishing method of the present invention.

Referring to FIG. 10, in the polishing method according to the present invention, the reference surface 3*a* (placement surface 11*a*) of the polishing apparatus 100 may be inclined by an angle θ from the horizontal plane while water for polishing such as distilled water can be dropped from the nozzle 4 during polishing, thereby increasing the cleaning effect during polishing and further improving polishing accuracy. The angle θ is preferably in the range of about 5 to 10 degrees. In this way, the rear side is higher than the front side of the polishing plate so that the polishing water washes towards the front any polishing waste and the like which is not retained by the cleaning surface or groove, thereby facilitating polishing accuracy in the subsequent polishing step.

A polishing test for the end surface of the single core ferrule was carried out using the polishing films 200 to 400 of the examples of the present invention and the polishing film 600 of the comparative example.

Example 1

(1) Conditions of the Polishing Apparatus
Size of the placement surface of the polishing plate (H×H') 145 mm×145 mm
Diameter of circular motion of the polishing plate (D) 15 mm
Linear movement distance of the polishing plate (S) 86 mm
Moving speed in a straight line of the polishing plate ($V_1$) 86 mm/5 min
Rotational speed of the polishing plate ($V_2$) 270 rpm
Water for polishing distilled water
(2) Conditions of Polishing Film
Polishing surface for rough polishing
Polishing film containing aluminum oxide abrasive grains having an average grain size of 9 μm
Polishing surface for intermediate polishing
Polishing film containing diamond abrasive grains having an average grain size of 1 μm
Polished surface for finish polishing
Polishing film containing silica particles having an average particle size of 20 to 30 nm
Cleaning Surface
Flocked film obtained by flocking nylon fiber (1 denier) having a length of 0.4 mm on a PET film
Longitudinal width of the cleaning surface (Lc>R) 9 mm
Groove width (Lg) About 0 mm
Polishing time ratio configuration
Rough polishing:intermediate polishing:finish polishing=1:1.5:1.3
(3) Determined Dimensions of the Polishing Film
L1'=10 (mm), L2'=15 mm, L3'=13 mm
L1=25 mm, L2=30 (mm), L3=72 mm Example 2

(1) Conditions of the Polishing Apparatus
Same as in Example 1
(2) Conditions of the Polishing Film
Same as in Example 1 for the polishing surface and the cleaning surface Longitudinal width of the cleaning surface (Lc≥R) 9 mm
Groove width (Lg) 0.5 mm
Polishing time ratio configuration
Rough polishing:intermediate polishing:finish polishing=1:1.5:1.1
(3) Determined Dimensions of the Polishing Film
L4'=10 (mm), L5'=15 mm, L3'=11 mm
L4=25 mm, L5=30 (mm), L6=70 mm Example 3

(1) Conditions of the Polishing Apparatus
Linear movement distance of the polishing plate (S) 96 mm
The other conditions are the same as in Example 1.
(2) Conditions of the Polishing Film
Same as in Example 1 for the polishing surface and the cleaning surface
Longitudinal width of the cleaning surface (Lc=D) 15 mm
Groove width (Lg) About 0 mm
Polishing time ratio configuration
Rough polishing:intermediate polishing:finish polishing=1:1.5:1.1
(3) Determined Dimensions of the Polishing Film
L7'=10 (mm), L8'=15 mm, L9'=11 mm
L7=25 mm, L8=30 (mm), L9=60 mm Comparative Example (1) Conditions of the Polishing Apparatus
Same as in Example 1
(2) Conditions of the Polishing Film
Same as in Example 1 for the polishing surface and the cleaning surface
No cleaning surface
Groove width (Lg) About 0 mm
Polishing time ratio configuration
Rough polishing:intermediate polishing:finish polishing=1:1.25:1.25
(3) Determined Dimensions of the Polishing Film
L11'=16 (mm), L22'=20 mm, L33'=20 mm
L11=31 mm, L22=35 (mm), L33=79 mm The polishing test was carried out for the end surface of the single core ferrule using the polishing films of Examples 1 to 3 and a comparative example, with a polishing apparatus 100, then the finished surfaces were observed. As a result of the test, regarding the polishing films of Examples 1 to 3, the end surface of the single core ferrule was finished into a mirror face, thereby sufficiently satisfying the working specifications. Regarding the polishing film of the comparative example, fine scratches were observed on the end surface of the ferrule.

In the present invention, the polishing film may be exchanged for each set of batch polishing (rough polishing, intermediate polishing and finish polishing). By doing so, the end surface of the workpiece can be finished uniformly into a mirror face for each batch polishing. According to the polishing method and the polishing film of the present invention, replacing polishing films or moving the workpiece to different polishing apparatus for each of the rough polishing, intermediate polishing and finish polishing processes, and/or separately performing a cleaning process is not necessary, thereby greatly reducing the number of polishing processes for polishing the connector end surface.

The present invention is not limited to the above embodiment, and various design changes can be made depending on the application without departing from the spirit and scope of the invention.

REFERENCE NUMERALS

100 Polishing apparatus
200 Polishing film 1

300 Polishing film 2
400 Polishing film 3

The invention claimed is:

1. A polishing method for performing multi-stage batch polishing on a workpiece, comprising:

moving an end surface of the workpiece and a polishing plate relative to each other within a plane parallel to a reference surface, bringing the end surface of the workpiece into contact with a polishing film disposed on the polishing plate;

moving the end surface of the workpiece in a circular motion with a diameter 2 R relative to the polishing film while moving the center of the circular motion linearly in one direction by a predetermined distance S on the polishing film;

wherein:

the polishing film is provided with first, second, and third polishing surfaces along the direction of linear movement, a length in the direction of linear movement of each of the polishing surfaces being equal to or greater than the diameter 2 R of the circular motion; and the polishing film is further provided with a first cleaning surface between the first and second polishing surfaces and a second cleaning surface between the second and third polishing surfaces so that a range included in the predetermined distance S, in which one rotation in the circular motion crosses over different polishing surfaces, is reduced, or so that one rotation in the circular motion does not cross over different polishing surfaces.

2. The polishing method as set forth in claim 1, wherein the first and second cleaning surfaces have lengths $Lc_1$ and $Lc_2$ in the direction of linear movement, respectively, each of $Lc_1$ and $Lc_2$ being equal to or greater than a radius R of the circular motion.

3. The polishing method as set forth in claim 1, wherein the first and second cleaning surfaces have lengths $Lc_1$ and $Lc_2$ in the direction of linear movement, respectively, each of $Lc_1$ and $Lc_2$ being equal to or greater than the diameter 2 R of the circular motion.

4. The polishing method as set forth in claim 1, wherein the polishing film is further provided with grooves arranged on both sides of the first and second cleaning surfaces.

5. The polishing method as set forth in claim 1, wherein the lengths in the direction of linear movement of the first, second, and third polishing surfaces are greater than the diameter 2 R by l1, l2 and l3, respectively, each of the values of l1, l2 and l3 being determined based on a desired polishing time on the first, second or third polishing surface.

6. The polishing method as set forth in claim 1, wherein the end surface of the workpiece and the polishing plate are moved relative to each other while the workpiece is fixed and the polishing plate is moved in a circular motion and linearly.

7. The polishing method as set forth in claim 1, wherein the polishing film is disposed on a placement surface of the polishing plate, the shape and size of the polishing film being equal to those of the placement surface.

8. The polishing method as set forth in claim 7, wherein the placement surface and the polishing film have square shapes whose side lengths are in a range of 140 to 150 mm, respectively.

9. The polishing method as set forth in claim 1, wherein the first, second, and third polishing surfaces contain particles that are different from each other;

the first and second cleaning surfaces comprise multiple fibers flocked on base materials;

the polishing surfaces and the cleaning surfaces substantially have the same height when the end surface of the workpiece is brought into contact by a predetermined pressing force with the first, second, and third polishing surfaces and the first and second cleaning surfaces.

10. The polishing method as set forth in claim 1, wherein the polishing film is further provided with one or more additional polishing surfaces, the one or more polishing surfaces and the other polishing surface being adjacent to each other via one or more additional cleaning surfaces, respectively.

11. The polishing method as set forth in claim 1, wherein the reference surface is inclined by a predetermined angle from a horizontal plane with water being supplied to the polishing film.

12. A polishing film used in a polishing method for performing multi-stage batch polishing on a workpiece by moving an end surface of the workpiece and a polishing plate in a circular motion with a radius R relative to each other within a plane parallel to a reference surface and by moving the center of the circular motion linearly by a predetermined distance S while bringing the end surface of the workpiece into contact with a polishing film disposed on the polishing plate, comprising:

first, second, and third polishing surfaces, each containing particles that are different from each other, and each having a length, along the direction of linear movement, equal to or greater than the diameter 2 R of the circular motion;

a first cleaning surface between the first and second polishing surfaces and a second cleaning surface between the second and third polishing surfaces so that a range included in the predetermined distance S, in which one rotation in the circular motion crosses over different polishing surfaces is reduced, or so that one rotation in the circular motion does not cross over different polishing surfaces;

wherein the first and second cleaning surface comprise multiple fibers flocked on base materials.

13. The polishing film as set forth in claim 12, wherein the first and second cleaning surfaces have lengths $Lc_1$ and $Lc_2$ along the direction of linear movement, respectively, each of $Lc_1$ and $Lc_2$ being equal to or greater than a radius R of the circular motion.

14. The polishing film as set forth in claim 12, wherein the first and second cleaning surfaces have lengths $Lc_1$ and $Lc_2$ along the direction of linear movement, respectively, each of $Lc_1$ and $Lc_2$ being equal to or greater than the diameter 2 R of the circular motion.

15. The polishing film as set forth in claim 12, further comprising:

grooves arranged on both sides of the first and second cleaning surfaces, respectively.

16. The polishing film as set forth in claim 12, wherein the second polishing surface comprises diamond particles having an average particle diameter of 1 μm.

17. The polishing film as set forth in claim 12, wherein, in the direction of linear movement, the length of the first polishing surface is in the range of 15 to 35 mm, the length of the second polishing surface is in the range of 20 to 40 mm, the length of the third polishing surface is in the range of 50 to 80 mm, the length of the first and second cleaning surfaces are in the range of 5 mm to 20 mm.

* * * * *